US006257839B1

(12) United States Patent
Fang et al.

(10) Patent No.: US 6,257,839 B1
(45) Date of Patent: Jul. 10, 2001

(54) DOUBLE SCREW ROTOR ASSEMBLY WITH ELECTRICALLY CONTROLLED CLEARANCE ADJUSTMENT MEANS

(75) Inventors: Hong-Sheng Fang; Ming-Hsin Liu; Jiun-Hung Chen, all of Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/589,127

(22) Filed: Jun. 8, 2000

(30) Foreign Application Priority Data

Feb. 2, 2000 (TW) ..... 089201921

(51) Int. Cl.[7] ..... F04B 49/08; F04C 18/16; F04C 29/10

(52) U.S. Cl. ..... 417/283; 418/14; 418/107; 418/194

(58) Field of Search ..... 418/14, 21, 107, 418/194; 417/283, 310

(56) References Cited

U.S. PATENT DOCUMENTS 1,323,459 * 12/1919 Dorr ..... 418/107

3,605,188 * 9/1971 McCormick et al. ..... 418/21

FOREIGN PATENT DOCUMENTS

384355 * 12/1932 (GB) ..... 418/194

* cited by examiner

*Primary Examiner*—John J. Vrablik
(74) *Attorney, Agent, or Firm*—Rabin & Champagne, P.C.

(57) ABSTRACT

A double screw rotor assembly includes two screw rotors meshed in a bushing inside a casing. The threads of the screw rotors have a constant pitch, and define with the bushing a plurality of air chambers in the pitch. The volumes of the air chambers reduce gradually from the inlet toward the outlet due to reduced tooth height so that the outer diameter defined by the tooth tip of the thread of each screw rotor has the shape of an invertedly disposed cone. An electric driving device is controlled to move the bushing axially in the casing relative to the screw rotors in adjusting the clearance between the inside wall of the bushing and the tooth tip of the thread of each screw rotor, so as to minimize the consumption of starting power and facilitate stable running of the screw rotors, Further, a O-ring is provided at the top wall of the busing and pressed on the casing to keep an airtight status, so as to improve the working efficiency.

10 Claims, 8 Drawing Sheets

DOUBLE SCREW ROTOR ASSEMBLY WITH ELECTRICALLY CONTROLLED CLEARANCE ADJUSTMENT MEANS

BACKGROUND OF THE INVENTION

The present invention relates to fluid machinery for controlling a fluid pressure, and more particularly to a double screw rotor assembly that can reduce starting power, start electric current, or adjust operating power. The double screw rotor assembly of the invention can be used in vacuum pumps, air compressors, water or oil pumps, or other fluid media.

FIG. 1 shows a double screw rotor assembly manufactured by KASHIYAMA INDUSTRIES, LTD., and designed for use in a vacuum pump. This structure of double screw rotor comprises two screw rotors 81 and 82 meshed together. Because the screw rotors 81 and 82 have a constant pitch P' and constant height of tooth H', the volume of air chamber 810 or 820 does not change while air is transferred from the inlet to the output end 80, a high pressure difference occurs, thereby causing a reverse flow of air, high noises, and waste of energy.

U.S. Pat. No. 5,667,370 discloses another structure of double screw rotor assembly. According to this design, as illustrated in FIG. 2, the meshed screw rotors 83 and 84 have same height of tooth H", and the pitch is gradually reduced in direction from the input side toward the output side 801 ($P_1>P_2$). Because of $P_1>P_2$, the volume of air chamber 830 or 840 is reduced during transmission, and the pressure in these chambers would be increased gradually. Therefore, when the air chambers were compressed and transmitted to the output end 801, less pressure difference occurs, the reverse flow of air would be reduced and so as to the high noise. However, because of different pitches and pressure angles are defined at different rotor sections, the fabrication process of the screw rotors 83 and 84 are complicated, resulting in a high manufacturing cost.

FIG. 3 shows still another structure of double screw rotor assembly, which was filed to USPTO for a patent by the present applicant under application Ser. No. 09/372,674. According to this design, two screw rotors are meshed together and mounted in a compression chamber inside a casing, each comprising a spiral thread around the periphery. The thread has a height H made gradually reduced from the input side toward the output side 90. The threads of the screw rotors define a constant pitch P in order to be manufactured easily. The volumes of the air chambers 910 and 920 reduce gradually from the input side toward the output side, so the pressure can be increased gradually during transmission of air, the consumption of operation power and noise can be reduced. Because a constant pitch P is provided and the height H is made gradually reduced from the input side toward the output side 90, the outer diameter D has the shape of an invertedly disposed cone, and the inner diameter d has the shape of a regular cone.

According to the aforesaid second and third prior art designs, much starting power is required when starting the double screw rotor assembly. As illustrated in FIG. 3, the pressure (i.e. the atmospheric pressure) in all air chambers 910 and 920, pressure Pi at the input side, and pressure P0 at the output side, at the initial stage are the same. Because the volumes of the air chambers 910 and 920 are gradually reduced during rotary motion of the screw rotors, the pressure Pmax near the output side surpasses the pressure P0 (=the atmospheric pressure) at the output side when starting the double screw rotor assembly. Therefore, much more power and electric current are required to drive the rotors 91 and 92 to conquer the flow pressure of all air chambers 910 and 920. A certain period of time after starting, the flow pressure at the input side 901 is gradually reduced (for example, being drawn into a vacuum state), causing the flow pressure in the air chambers 910 and 920 near the input side 901 to be gradually reduced, and hence the electric power consumed is gradually reduced to the level of the rated working power. Because high working power is required when starting the double screw rotor assembly, high current, noise and vibration occur at the initial state when starting the screw rotors, resulting in an unstable operation.

FIG. 4 shows another prior art design constructed according to U.S. Pat. No. 5,533,887. According to this design, a movable case is sliding in a fixed case, however the spring at the top of the movable case is not adjustable, and the presence of the gap 22C which is left between the movable case and the fixed case for enabling the movable case to slide in the fixed case which may cause air leakage directly from the high pressure area to the low pressure area, thereby causing a low working efficiency. Further, if the process gas condensed in the gap between movable and fixed cases, the movable case maybe jammed at some position, and the bypass mechanism failed.

In view of the drawbacks of the aforesaid prior art designs, there is a strong demand for a high performance double screw rotor assembly that requires low starting power, and can be conveniently adjusted to fit different manufacturing requirement.

SUMMARY OF THE INVENTION

The present invention has been accomplished to provide a double screw rotor assembly, which eliminates the aforesaid drawbacks. It is one object of the present invention to provide a double screw rotor assembly, which reduces starting power and starting current by adjusting its internal pressure difference, allows the user to adjust operating power for a stable operation, and can be freely adjusted to change the clearance between the rotors and the casing subject to different manufacturing requirements. It is another object of the present invention to provide a double screw rotor assembly, which prevent a leakage to achieve a high performance. According to one aspect of the present invention, the double screw rotor assembly comprises a casing having a receiving chamber; an inlet and an outlet; a bushing axially movably mounted in the receiving chamber inside the casing, the bushing having an inside wall defining a receiving chamber, and an outside wall fitting with the inside wall of the casing; guide means provided to guide axial movement of the bushing relative to the casing; two screw rotors meshed together and mounted in the receiving chamber inside the bushing; and an electric driving means controller to move the bushing axially in the casing relative to the screw rotors to adjust inside pressure in the bushing. According to another aspect of the present invention, the electric driving means comprises at least one rack fixedly mounted in the bushing, and a driving gear meshed with the at least one rack and rotated by, for example, a motor or other electric driving apparatus to move the at least one rack. Chain transmission means, belt transmission means, electromagnetic induction type transmission means may be used instead of the gear and rack transmission mechanism. According to still another aspect of the present invention, the double screw rotor assembly further comprises an O-ring mounted on the top wall of the busing and facing the casing. The O-ring can be made of rubber or any suitable equivalent material. According to still another aspect of the present invention, the double screw rotor assembly further comprises control means controlling the operation of the electric driving means, the control means comprising pressure sensor means, temperature sensor means, wattmeter, or voltmeter which detects the pressure or temperature in the receiving chamber near the outlet, or the value of electric current or voltage at the motor, for enabling the control means to control the electric driving means in moving the bushing subject to the value detected by the pressure sensor means. According to still another aspect of the present invention, the guide means comprises at least one sliding groove formed on the outside wall of the bushing, and at least one guide rib respectively formed integral with the inside wall of the casing and coupled to the at least one sliding groove on the bushing. The sliding groove and the guide rib can be made having any of a variety of designs that facilitate stable movement of the bushing relative to the casing. Further, the outer diameter of the thread of each screw rotor can be made linearly, non-linearly reduced from the inlet to the output, having a convex or concave profile.

DETAILED DESCRIPTION OF THE PREFERRED EMBODIMENT

Figure 1:
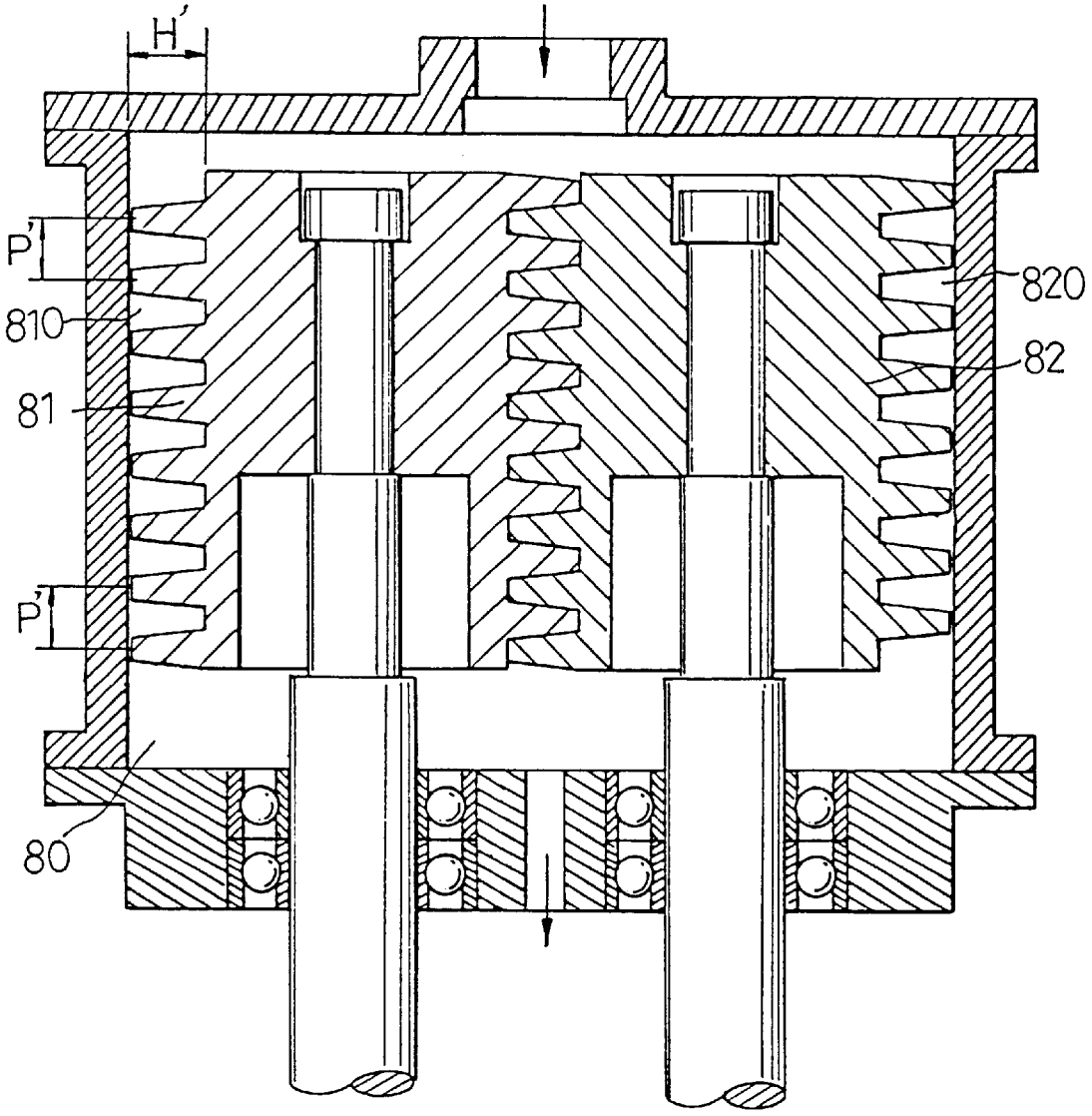
Fig. 1 (PRIOR ART)
FIG. 1 is a sectional view of a double screw rotor assembly according to the prior art.
Figure 2:
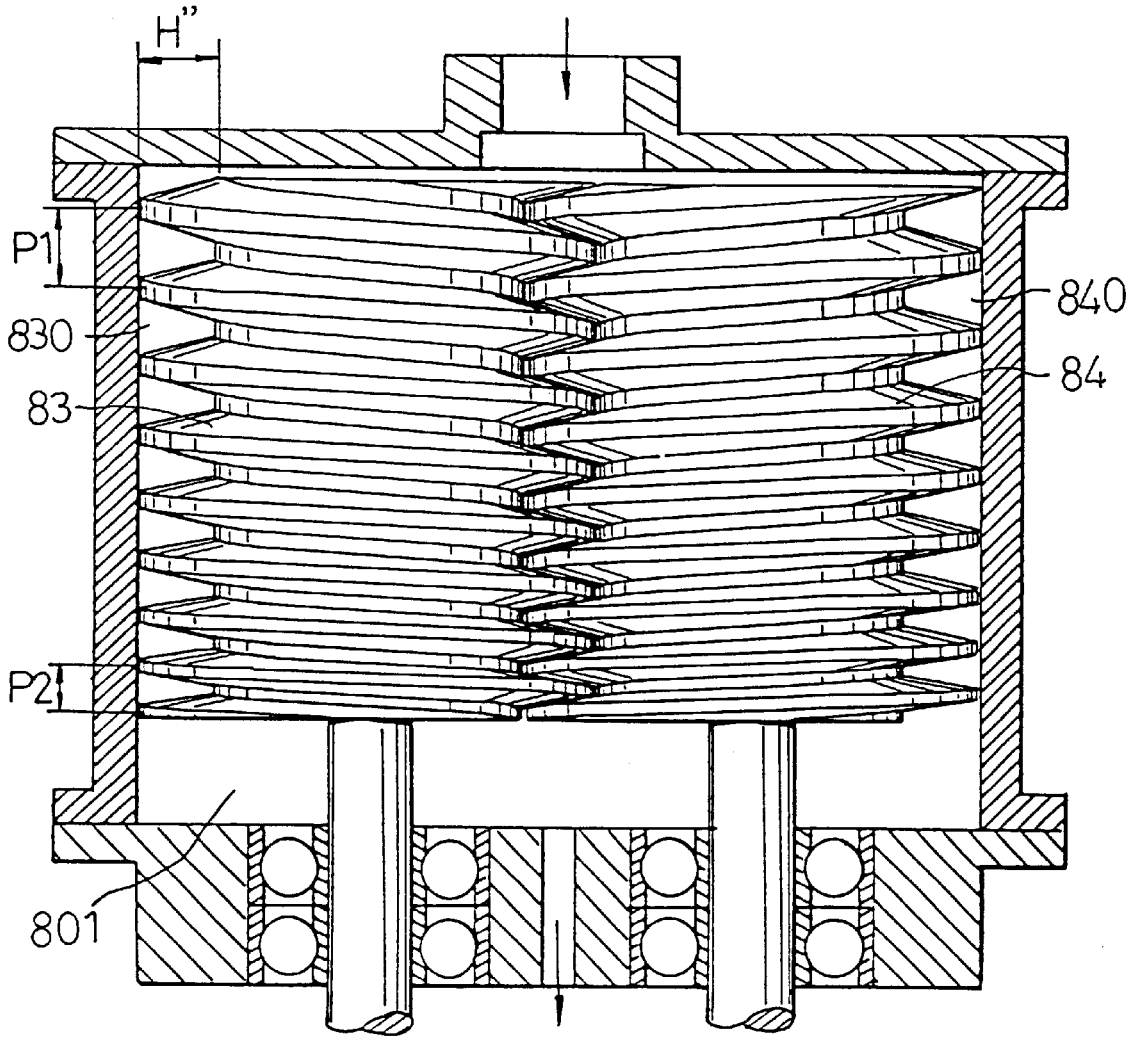
Fig. 2 (PRIOR ART)
FIG. 2 is a sectional view of another structure of double screw rotor assembly according to the prior art.
Figure 3:
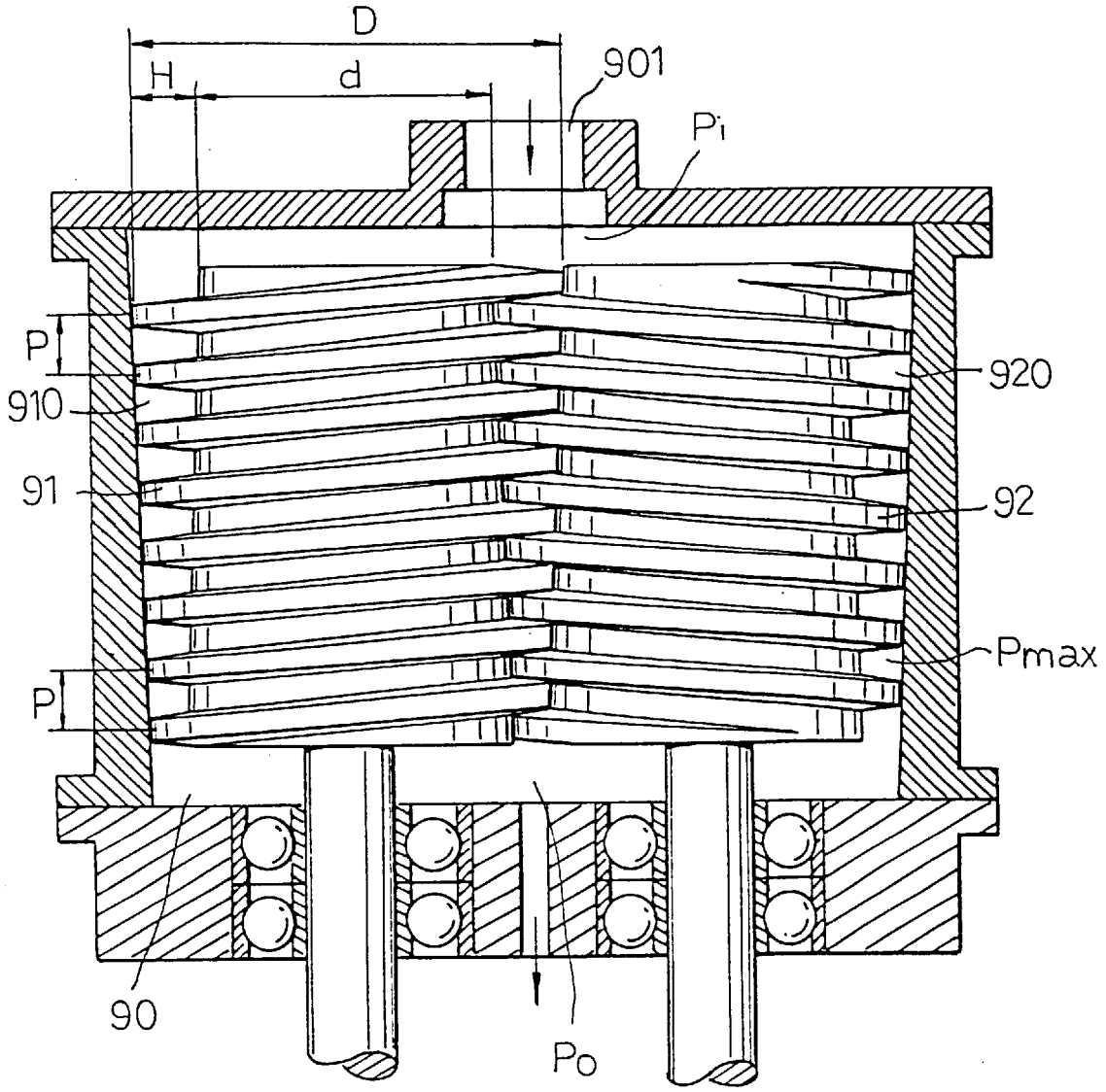
Fig. 3 (PRIOR ART)
FIG. 3 is a sectional view of still another structure of double screw rotor assembly according to the prior art.
Figure 4:
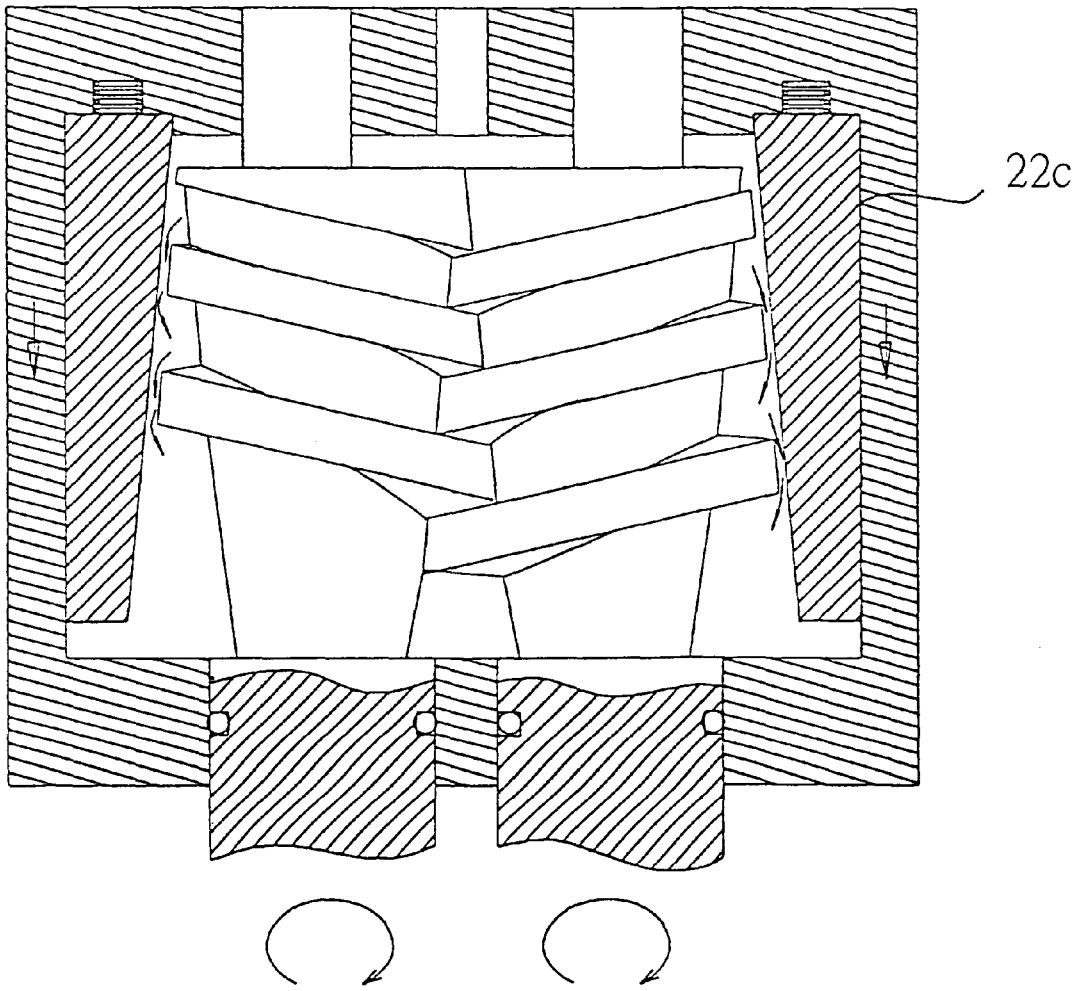
Fig. 4 (PRIOR ART)
FIG. 4 is a sectional view of still another structure of double screw rotor assembly according to the prior art.
Figure 5:
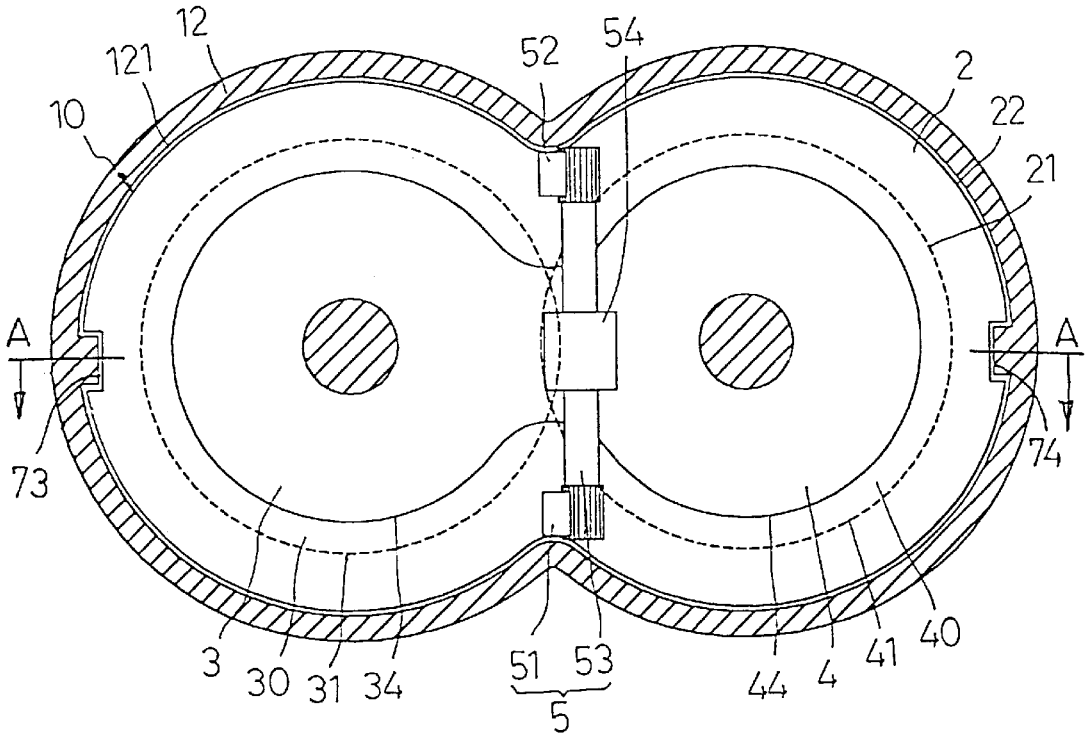
FIG. 5 is a bottom view of a double screw rotor assembly after removal of the bottom cover according to the present invention.
Figure 6:
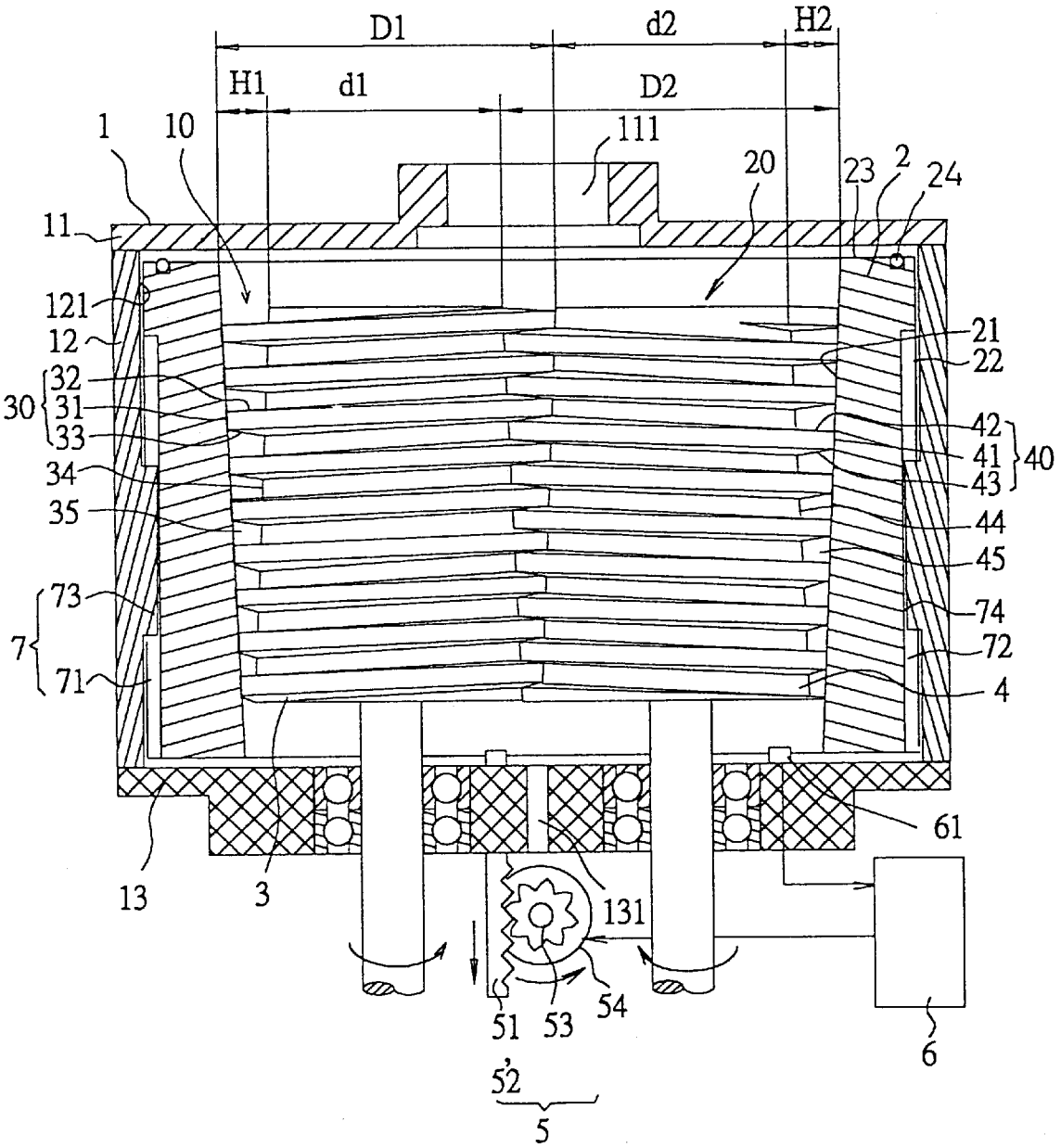
FIG. 6 is a sectional view AA of the double screw rotor assembly shown in FIG. 5.

Referring to FIGS. 5 and 6, a double screw rotor assembly used in a vacuum pump in accordance with the present invention is shown comprised of a casing 1, a bushing 2, two screw rotors 3 and 4, and an electric driving device 5.

The casing 1 comprises a top cover 11, a peripheral shell 12, and a bottom cover 13. The top cover 11 has an inlet 111 connected to a container to be drawn into a vacuum status. The peripheral shell 12 comprises an inside wall 121 defining a receiving chamber 10. The bottom cover 13 comprises an outlet 131 disposed in communication with the atmosphere.

The bushing 2 has a loop-like, or more specifically, double loop-like cross section mounted in the receiving chamber 10 inside the casing 1, comprising an inside wall 21, a receiving chamber 20 defined within the inside wall 21, a top wall 23, a rubber O-ring 24 around the top wall 23, and an outside wall 22 fitting the inside wall 121 of the peripheral shell 12 of the casing 1. Further, guide means 7 is provided for enabling the bushing 2 to be moved axially relative to the casing 1. The guide means 7 comprises two longitudinal sliding grooves 71 and 72 respectively formed on the outside wall 22 at two opposite sides, and two longitudinal guide ribs 73 and 74 respectively bilaterally formed integral with the inside wall 121 of the peripheral shell 12 of the casing 1 and coupled to the longitudinal sliding grooves 71 and 72.

The two screw rotors 3 and 4 are meshed together, and mounted inside the receiving chamber 20 in the bushing 2. Each screw rotor 3 or 4 comprises a spiral thread 30 or 40 raised around the periphery (Alternatively, the screw rotors 3 and 4 can be made having two or more threads). The tooth tip 31 and 41 of the threads 30 and 40 of the screw rotors 3 and 4 are respectively spirally extended, defining a respective outer diameter D1 and D2 and meshed with each other. As illustrated, the threads 30 and 40 have a constant pitch, and the outer diameter D1 or D2 reduces gradually and linearly from the inlet 111 toward the outlet 131.

The thread 30 or 40 defines with the inside wall 21 of the bushing 2 a plurality of air chambers 35 or 45 in the respective pitch, i.e., the root of tooth 34 or 44, the side walls 32 and 33, or, 42 and 43, and the inside wall 21 of the bushing 2 define a plurality of air chambers 35 or 45. As illustrated, the outer diameters D1 and D2 that are formed of the tooth tip 31 and 41 of the threads 30 and 40 of the screw rotors 3 and 4 fit the inside wall 21 of the bushing 2, therefore the inside wall 21 of the bushing 2 is tapered linearly. Each thread 30 or 40 has two side walls 32 and 33, or, 42 and 43. The root of tooth 34 or 44 defines an inner diameter d1 or d2 having the shape of a regular cone. Because the tooth height H1 or H2 gradually reduces in direction from the inlet 111 toward the outlet 131, the volumes of the air chambers 35 or 45 were gradually reduced in direction from the inlet 111 toward the outlet 131.

The aforesaid electric driving device 5 is comprised of two racks 51 and 52, a driving gear 53 meshed with the racks 51 and 52, and a motor 54 controlled to turn the driving gear 53. Upon rotary motion of the driving gear 53, the bushing 2 is moved with the racks 51 and 52 axially relative to the screw rotors 3 and 4. By means of the effect of the guide means 7, the axial movement of the bushing 2 is accurate and stable.

Figure 7:
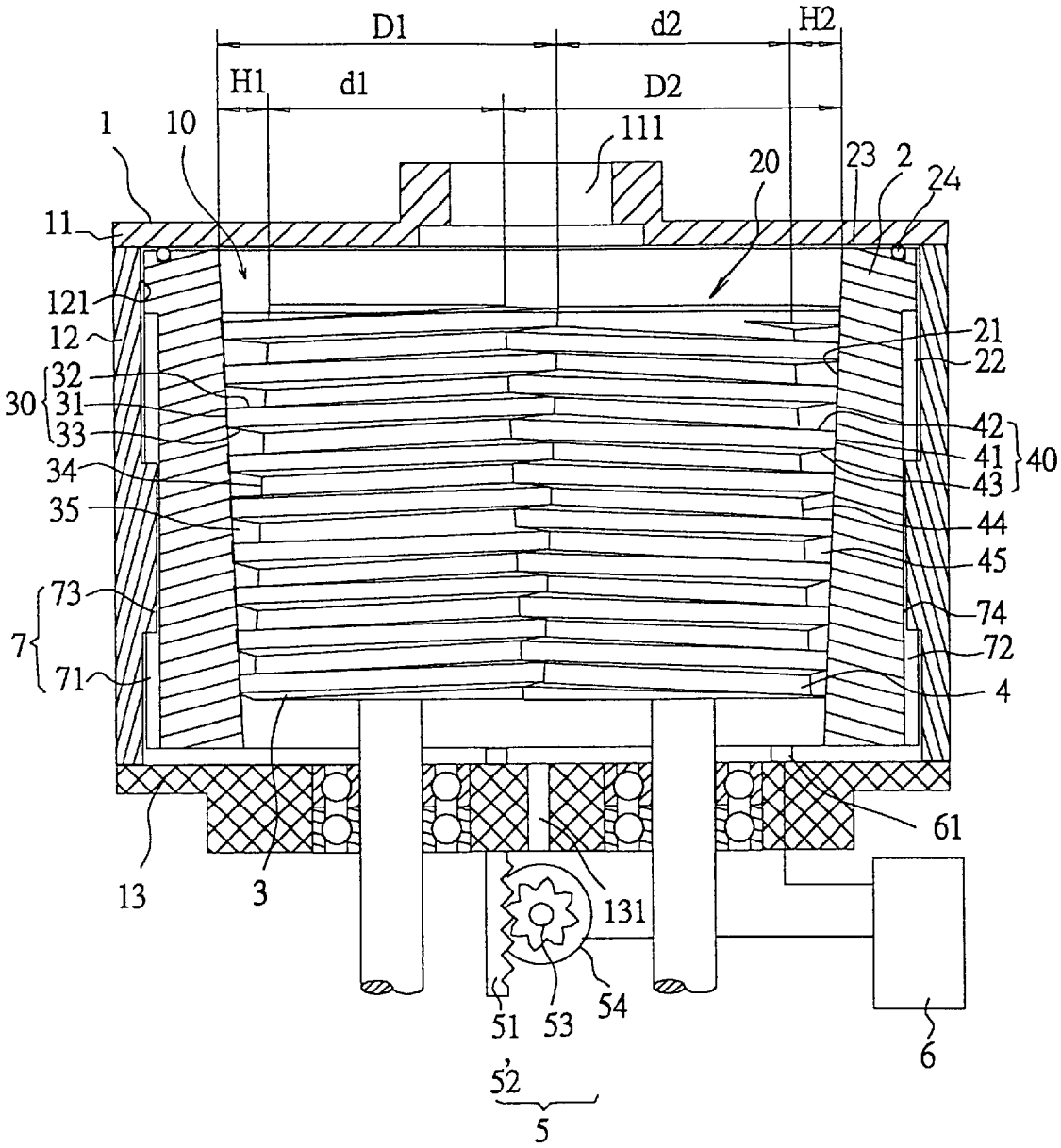
FIG. 7 is a sectional view of the present invention showing the initial stage of the double screw rotor assembly when started.
Figure 8:
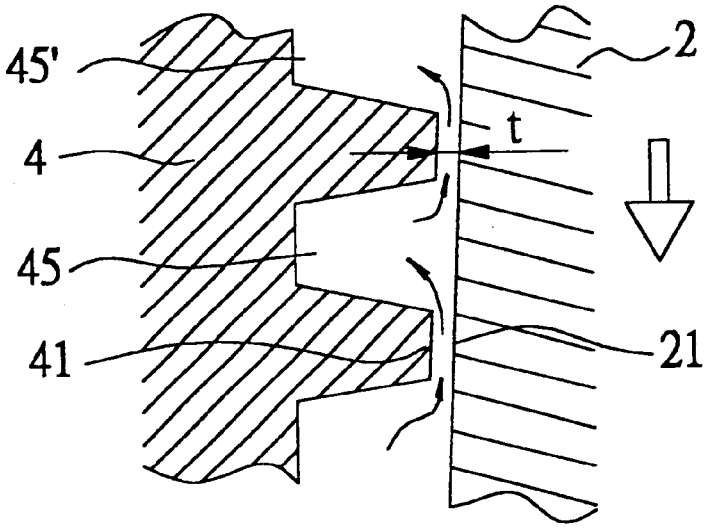
FIG. 8 is an enlarged view in section of a part of the present invention showing the initial stage of the double screw rotor assembly when started.

Referring to FIG. 7, when starting the double screw rotor assembly, the flow pressure in the air chambers 35 and 45 between the inlet 111 and the outlet 131 is equal to the atmosphere at the beginning. At this stage, the motor 54 is operated to move the bushing 2 slightly axially downwards. The O-ring 24 at the top wall 23 of the bushing 2 is released from pressure, enabling gas to leak from the lower high pressure area to the upper low pressure area via gap between the outside wall 22 and top wall 23 of the bushing 2. As illustrated in FIG. 8, because the outer diameter D2 of the screw rotor 4 has the shape of an invertedly disposed cone, minor downward displacement of the bushing 2 causes the clearance t between the inside wall 21 and the tooth tip 41 to be relatively larger, enabling air to leak from the air chamber 45 of relatively higher pressure to the air chamber 45' of relatively lower pressure via the clearance t. This design prevents simultaneous compression of the air chambers 45 and 45' in the same time when the air chambers 45 and 45' are at the atmosphere, and therefore it is not necessary to start the double screw rotor assembly with high power and high electric current.

Figure 9:
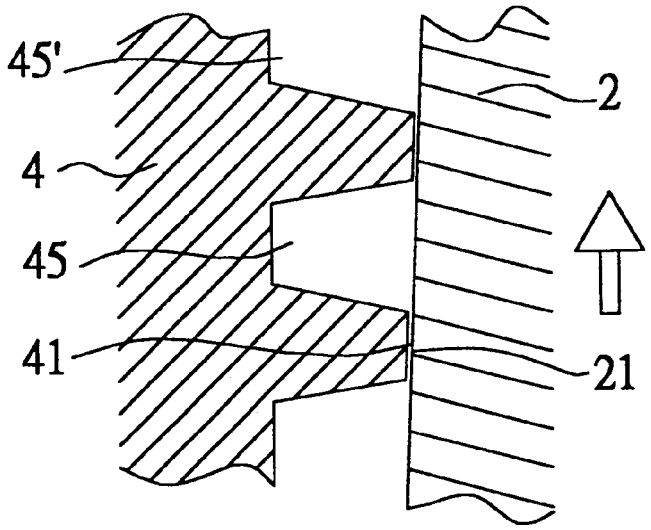
FIG. 9 is an enlarged view in section of a part of the present invention, showing the status of the double screw rotor assembly a certain period of time after starting.

Referring to FIG. 9, a certain period of time after starting, the flow pressure around the inlet 111 is gradually reduced, and the pressure of the air chambers 45 and 45' is relatively reduced, and the motor 54 is then driven to move the bushing 2 axially upwards and make the gap between the inside wall 21 of the bushing 2 and the tooth tip 41 smaller, and the O-ring 24 at the top wall 23 of the bushing 2 is compressed and maintained in the sealing status (see FIG. 7), preventing gas leakage from the high pressure side to the receiving chamber 20 via the outside wall 22 and top wall 23 of the bushing 2, and therefore the working efficiency is greatly improved.

The application of the present invention is not limited to the starting stage. The invention can also be applied to control the stability of the operating power during running of the double screw rotor assembly, or used for safety control or adjusting the clearance between the rotors and the casing subject to different manufacturing requirements. For example, a control device 6 may be added to the double screw rotor assembly (see FIG. 5). The control device 6 comprises a pressure sensor 61 (or temperature sensor) disposed inside the receiving chamber 10 near the outlet 131 to detect the pressure (or temperature) of air in the high-pressure area. When the detected pressure (or temperature) surpasses a predetermined value, the control device 6 immediately outputs a signal to the motor 54, causing the motor 54 to move the bushing 2 slightly axially downwards (see FIG. 7), therefore the electric current and voltage would be stable, preventing an excessively high operating power. When an overpressure or overheat unexpectedly occurs, the bushing 2 can be rapidly axially moved downwards to prevent an accident.

It is to be understood that the drawings are designed for purposes of illustration only, and are not intended for use as a definition of the limits and scope of the invention disclosed.

What the invention claimed is:

1. A double screw rotor assembly comprising:

a casing, said casing comprising an inside wall defining a receiving chamber, an inlet and an outlet respectively disposed in communication with the receiving chamber of said casing;

a bushing mounted in the receiving chamber inside said casing and moved axially along the inside wall of said casing, said bushing comprising an inside wall defining a receiving chamber, and an outside wall fitting the inside wall of said casing;

an O-ring mounted on a top wall of said bushing and disposed between said bushing and said casing to seal the gap between said bushing and said casing;

guide means to guide movement of said bushing in axial direction relative to said casing;

two screw rotors meshed together and mounted in the receiving chamber inside said bushing;

an electric driving means controlled to move said bushing axially in said casing relative to said screw rotors; and control means to control the operation of said electric driving means, said control means comprising pressure sensor means which detects the pressure in the receiving chamber near said outlet, for enabling said control means to control said electric driving means in moving said bushing subject to the pressure value detected by said pressure sensor means.

2. The double screw rotor assembly of claim 1 wherein said guide means comprises at least one sliding groove formed on the outside wall of said bushing, and at least one guide rib respectively formed integral with the inside wall of said casing and coupled to the at least one sliding groove on said bushing.

3. The double screw rotor assembly of claim 1 wherein said casing is comprised of a peripheral shell, a top cover, and a bottom cover.

4. The double screw rotor assembly of claim 1 wherein said bushing has a double loop-like cross section.

5. The double screw rotor assembly of claim 1 wherein said electric driving means comprises at least one rack fixedly mounted in said bushing, and a driving gear meshed with said at least one rack and rotated to move said at least one rack.

6. The double screw rotor assembly of claim 5 wherein said electric driving means further comprises a motor controlled to turn said driving gear.

7. The double screw rotor assembly of claim 1 wherein said screw rotors each comprise at least one spiral thread.

8. The double screw rotor assembly of claim 7 wherein said at least one spiral thread of each of said screw rotors each has a root of tooth and side walls that define with the inside wall of said bushing at least one air chamber, and the air chambers defined between said screw rotors and the inside wall of said bushing have a volume gradually reduced from said inlet toward said outlet.

9. The double screw rotor assembly of claim 7 wherein said at least one spiral thread of each of said screw rotors has a constant pitch, and the tooth tip of said at least one spiral thread of each of said screw rotors defines an outer diameter having the shape of an invertedly disposed cone.

10. The double screw rotor assembly of claim 9 wherein said outer diameter gradually linearly reduces from said inlet toward said outlet.

* * * * *